United States Patent [19]

Rall et al.

[11] 4,237,413

[45] Dec. 2, 1980

[54] CIRCUIT ARRANGEMENT FOR STABILIZING A DIRECT CURRENT

[75] Inventors: Bernhard Rall, Ulm; Dietrich Höppner, Wippingen, both of Fed. Rep. of Germany

[73] Assignee: Licentia Patent-Verwaltungs-G.m.b.H., Frankfurt am Main, Fed. Rep. of Germany

[21] Appl. No.: 834,865

[22] Filed: Sep. 20, 1977

[30] Foreign Application Priority Data

Sep. 22, 1976 [DE] Fed. Rep. of Germany ..... 2642512

[51] Int. Cl.[3] ..... G05F 1/56

[52] U.S. Cl. ..... 323/4; 323/22 T

[58] Field of Search ..... 323/1, 4, 8, 9, 22 T; 307/296 R, 297

[56] References Cited

U.S. PATENT DOCUMENTS

| | | | |
|---|---|---|---|
| 3,761,801 | 9/1973 | Sheng | 323/4 |
| 3,813,595 | 5/1974 | Sheng | 323/4 |
| 3,906,332 | 9/1975 | Keller | 323/4 |

FOREIGN PATENT DOCUMENTS

| | | | |
|---|---|---|---|
| 2647640 | 4/1977 | Fed. Rep. of Germany | 323/4 |

*Primary Examiner*—William M. Shoop

*Attorney, Agent, or Firm*—Spencer & Kaye

[57] ABSTRACT

A circuit arrangement for stabilizing a direct current comprises a parallel controller for controlling a transistor connected in series with the load.

14 Claims, 9 Drawing Figures

FIG.1 PRIOR ART
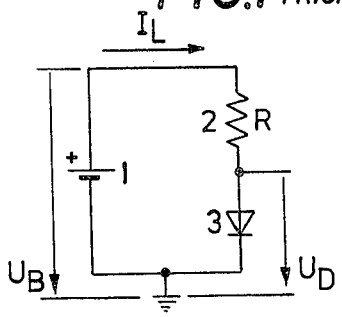
FIG.2
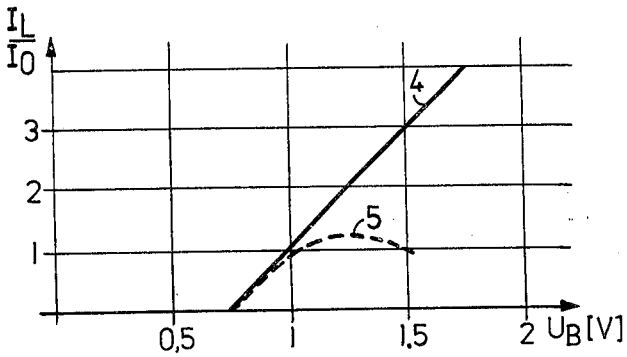
FIG.3
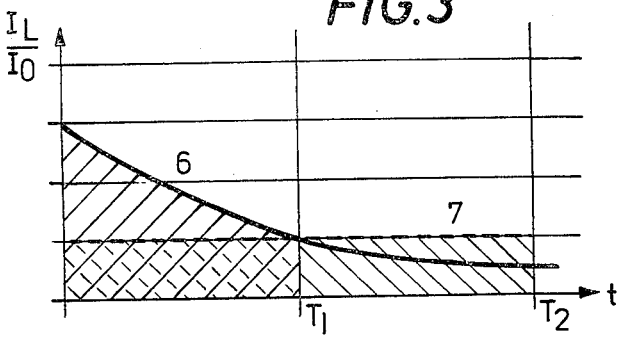
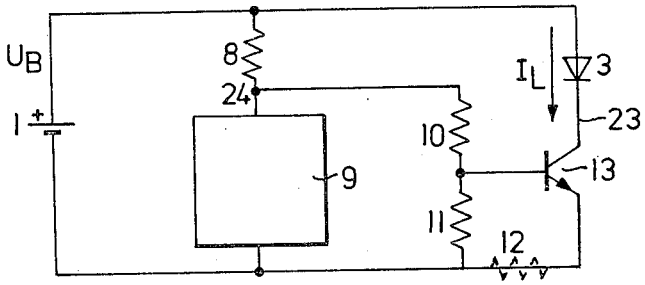
FIG.4
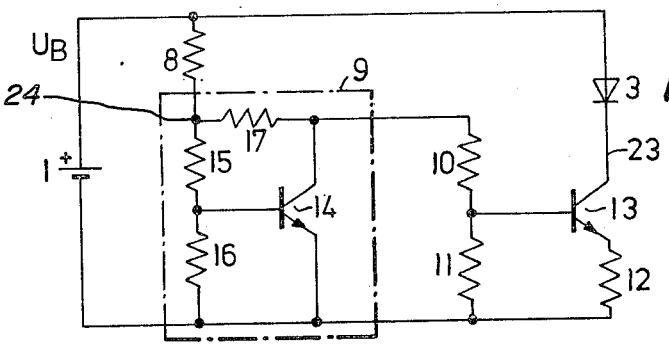
FIG.5

FIG. 6
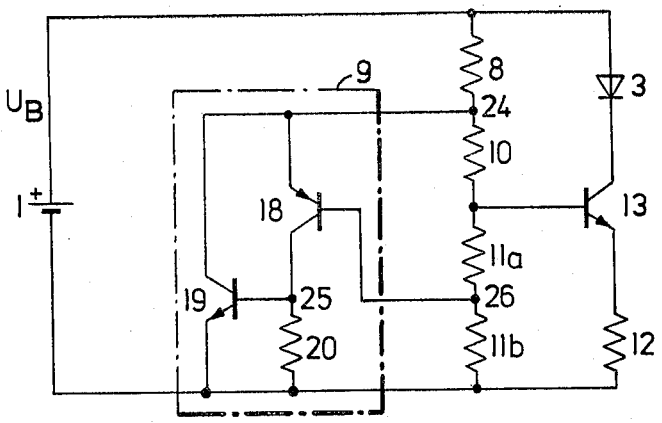
FIG. 9
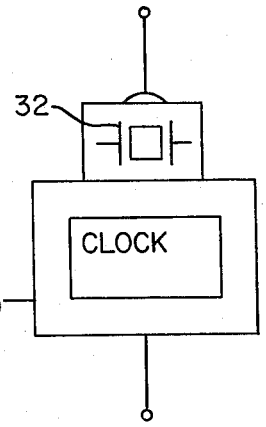
FIG. 7
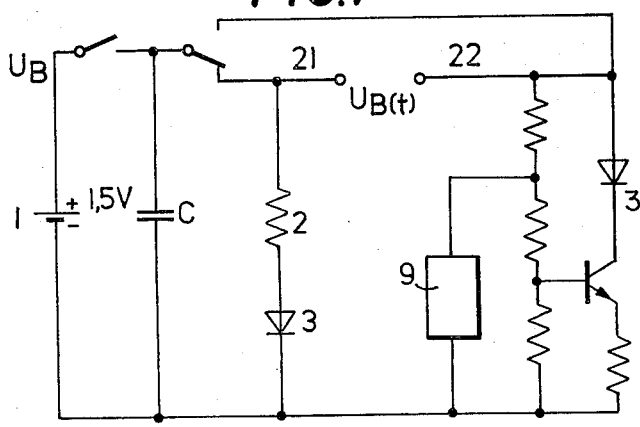
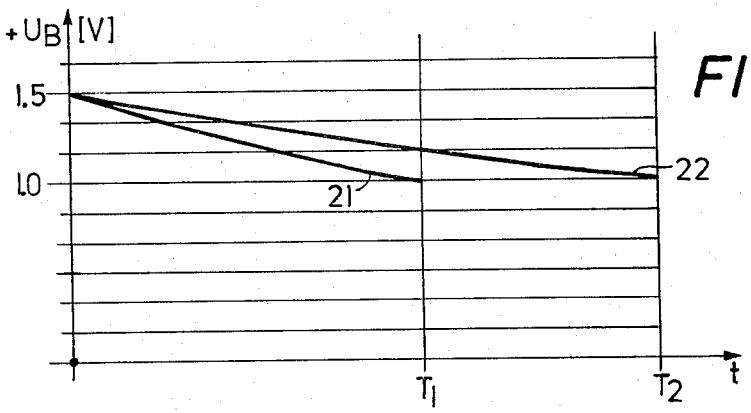
FIG. 8

CIRCUIT ARRANGEMENT FOR STABILIZING A DIRECT CURRENT

BACKGROUND OF THE INVENTION

The invention relates to a circuit arrangement for stabilizing a direct current which serves particularly for the purpose of feeding an integrated injection logic circuit, hereinafter called an $I^2L$ circuit.

Electronic general-purpose clocks are required to be fed from a dry-cell battery and to manage for as long as possible with one battery. If the operating current of an $I^2L$ circuit, whose operating voltage is at 750 to 800 mV, is derived from a resistor, then fluctuations in the operating current of 3:1 result when there is a change in the operating voltage from 1.5 V to 1 V. If the resistor is designed for a minimum voltage of 1 V then a substantially higher current than necessary is drawn off for one part of the lifespan of the battery and the battery is rapidly discharged.

SUMMARY OF THE INVENTION

The invention has for an object to provide a circuit arrangement for the purpose of stabilizing a direct current, the arrangement being integratable and capable of keeping the operating current for the load, more particularly an $I^2L$ logic circuit, roughly at the same level for the entire range of the operating voltage. Moreover, the stabilizing circuit should be capable of being used at a minimum difference voltage of 250 mV between the voltage source and the load.

According to a first aspect of the invention there is provided a circuit arrangement for stabilizing a direct current supplied to a load comprising a transistor connected in series with the load and a parallel controller for controlling the transistor.

According to a second aspect of the invention, there is provided a circuit arrangement for the purpose of stabilizing a direct current, which serves more particularly to feed an integrated $I^2L$ logic circuit, characterized in that it comprises a parallel controller and a transistor, with the parallel controller controlling the transistor and with the transistor in series with the load.

BRIEF DESCRIPTION OF THE DRAWINGS

The invention will now be described in greater detail, by way of example, with reference to the drawings, in which:

FIG. 1 shows the conventional current supply of an $I^2L$ circuit;

FIG. 2 shows the dependence of the load current on the battery voltage and the desired control curve;

FIG. 3 shows the discharge current intensity as a function of time with and without current control at a given battery capacitance;

FIG. 4 shows the general circuit in accordance with the invention;

FIG. 5 shows a first embodiment of the circuit in accordance with FIG. 4, FIG. 6 shows a second embodiment of the circuit;

FIG. 7 shows a measurement circuit for measuring the service life of the battery at different $I^2L$ current supplies, and FIG. 8 shows the discharge curves measured in a circuit according to FIG. 7.

FIG. 9 shows a quartz crystal clock load for use in the embodiments of FIGS. 4–6.

DESCRIPTION OF THE PREFERRED EMBODIMENTS

In a circuit arrangement of the type already mentioned, the invention comprises a parallel controller and a transistor, whereby the parallel controller, connected to a series resistor acts as a voltage stabilizing circuit which draws a shunt current to maintain the output voltage, controls the base-emitter voltage of the transistor and wherein the transistor is in series with the load.

In a refinement of the invention the parallel controller has a transistor and a voltage divider. Between the voltage divider and the collector of the transistor is located preferably a resistor. This resistor has the task of reducing the output voltage of the parallel controller at high input voltages in a disproportionate manner in order to obtain a curved or non-linear characteristic line and thus smaller mean desired value deviations. With another refinement of the invention the parallel controller has two complementary transistors which may also be designated as compound transistors, having a collector base connection. In preferred manner a resistor lies between the collector base connection and the reference potential. This resistor has the task of setting a suitable direct current operating point at which the output voltage of the parallel controller is also reduced at high input voltages in order to achieve a curved characteristic.

Referring now to the drawings, FIG. 1 shows the conventional current supply of an $I^2L$ circuit. A current $I_L$ from a battery 1 is applied to the $I^2L$ circuit 3 via a resistor 2, the current/voltage characteristic of circuit 3 corresponding to a silicon diode, the voltage $U_d$ thereacross remaining almost constant at 750 mV. In FIG. 2 it may be seen that the load current $I_L$ increases proportional to $U_B-U_d$ and at 1.5 V has three times the value of $L_{Lo}$ at $U_B=1$ V.

A dry-cell battery (monocell) has a new voltage of 1.5 V which reduces almost constantly at a constant discharge current, until at any final voltage of 1 V for example or even less the end of its capacity is established. A continuous voltage drop at constant discharge current is the characteristic of a capacitor so that it may be used instead of a battery for rough calculations or measurements. A monocell would have a capacitance of $C=72\,000$ F or $7.2\cdot10^{10}/\mu$F for example at 10 Ah with a discharge from 1.5 V to 1 V.

The battery discharge time in the circuit of FIG. 1 can be calculated as follows.

Generally, the discharge time of the exponential discharge is:

$$T_1 = R.C.\ \ln \frac{U_{Bo} - U_d}{I_{Lo} \cdot R} \tag{1}$$

where C is an equivalent capacitance of the battery.

The function $T_1$ (R) has a flat maximum at $dT_1/dR=0$, whereby $(U_{Bo}-U_d)\ I_{Lo}\cdot R=e=2.718$. At $U_{Bo}=1.5$ V and $U_d=0.75$ V the result is an $I_{Lmin}\cdot R$ of 0.276 V, i.e. the minimum current $I_{Lo}$ would be achieved at a discharge end-voltage of $0.75+0.276=1.026$ V.

With an error of 0.5%, 1.0 V is used as a discharge end voltage. $T_1$ is then 1.098 RC. The discharge current time area 6 in accordance with FIG. 3 is $$\int_0^{T_1} I_L \cdot dt = I_{Lmax} \cdot RC\,(1 - e^{-T_1/RC})$$
$$= I_{Lmax} \cdot RC \cdot 0.6666$$
$$= I_{max} \cdot 0.60716 \cdot T_1.$$

With the same discharge current time area which would correspond to the available battery capacity, the circuit could be operated for a time $T_2$ with a constant current $I_{Lo} = \frac{1}{3} \cdot I_{Lmax}$.

$$T_2 \cdot I_{Lo} = I_{Lmax} \cdot 0.60716 \cdot T_1$$

$$T_2/T_1 = I_{Lmax} \cdot 0.60716/I_{Lo}$$

$$T_2/T_1 = 2.0238 \approx 2$$

When discharged by a constant current a battery has double the discharge time as during exponential discharge in accordance with FIG. 3. For this reason, a circuit has been sought which keeps the load current $I_L$ almost constant as indicated in FIG. 2.

The ideal solution would be a constant current source instead of the resistor 2. It is approximated by the solution in accordance with the invention according to FIG. 4. The $I^2L$ circuit is symbolized by the diode 3, the minus potential 23 of which is now connected to the negative terminal of the battery via a current controlling transistor 13.

In order to control the transistor 13 at a constant collector current $I_L$ in accordance with the invention, a parallel controller circuit 9 is provided which keeps the point 24 at a constant voltage and thus facilitates approximately constant controlling of the transistor 13. The controlling action may be further stabilized at currents $I_L < 10$ mA by adding an emitter resistor 12. Only the parallel control circuit is in a position to stabilize, i.e. to keep the potential 24 constant by deriving a shunt current through resistor 8, according to its voltage control range down to 0.6 to 0.8 V. All of the remaining control circuit alternatives on the other hand fail at this point because the voltage of a minimum of 1 V is not sufficient for use in multiple-stage accurate control amplifiers. Moreover, the entire circuit should be carried out in monolithic, integrated technology, where resistors $>10$ K$\omega$ take up a disproportionately large area and are undesirable.

FIG. 5 shows the circuit according to FIG. 4 with a parallel controller known per se comprising transistor 14, the voltage divider 15/16 and an additional resistor 17. Without resistor 17, the parallel controller attempts to keep the potential 24 constant. It adjusts itself so that the voltage divided down by the potential at 24 corresponds exactly to the emitter-base voltage of the transistor 14. If the potential 24 rises then the transistor 14 is controlled and draws current and thus lowers the point 24 again. The higher $U_B$ the higher the potential 24 would be (obviously with substantially smaller voltage differences). However since at fairly high voltages the transistor 13 emits more current at the same emitter base voltage, a constantly increasing drive would not be optimal. Therefore the resistor 17 is introduced with the aid of which point 24 is lowered again at high voltages. As a result the curved characteristic line 5 of the starting current may be set in accordance with FIG. 2 with deviations of 1.3:1 from the desired value. The voltage divider 10, 11 has been taken into FIG. 5 from FIG. 4, but the best results are obtained with the circuit of FIG. 5 if the resistor 10 has the value zero and the resistor 11 as the value "infinity". FIG. 6 shows a circuit which is of equal electrical value and has a new parallel controller which contains a complementary combined transistor and manages without the voltage divider 15/16. If the voltage rises at 24 then PNP transistor 18 is controlled by the increased voltage between 24 and 26 and via the resistor 20 increases the emitter base voltage of the NPN transistor 19 which lowers the potential 24 again similarly to the transistor 14. By matching the selection of resistors 20 and 11*a* the operating point of the transistors 18 and 19 may be set so that the curved $I_L$ characteristic 5 in accordance with FIG. 2 is also formed.

The circuit according to FIG. 6 may be integrated in integrated technology together with $I^2L$ circuits on a chip, if in a known manner insulation diffusion with $P^+$ material is undertaken in order to separate the $I^2L$ transistors and the bipolar transistors 13,14 or 18 and 19. Very large areas are needed by the resistors 20 (this may be realized as a pinch resistor), 11*a* and 11*b*, and 10 as well as the transistor 13 but overall this is still so small that the whole circuit may be housed between the connecting pads at the edge of a chip.

A quality comparison of dimensioning of the circuit in accordance with the invention according to FIGS. 5 or 6 with the circuit according to FIG. 1 for the same $I_{Lo}$ at 1 V may be carried out in the circuit according to FIG. 7 with the aid of an oscillograph or a time recorder. A C equivalent to the battery of approximately 5000 to 10000 /$\mu$F is charged up to 1.5 V and then discharged via the $I^2L$ current supplies. The discharge curves, see FIG. 8, are drawn in and the intersection point is determined at 1 V in order to determine the times $T_1$ and $T_2$. The relationship between $T_2/T_1$ is the criterion of quality for the correction through the circuit in accordance with the invention, this criterion may of course also be determined by calculation for real discharge curves. Batteries for clock circuits could continue for approximately 1 year, and this means an average current consumption of the order of magnitude of 1 mA. In order to be able to use cheap and stable clock quartz, the operating frequency of the oscillator must be in the range of some MHz. Since rapid dividing circuits always require a certain current, current must be used as sparingly as possible. The circuit in accordance with the invention facilitates the use of cheaper clock quartz with the same minimum current loading or facilitates the transition from expensive alkali or mercury batteries to the cheaper zinc carbon batteries.

FIG. 9 shows an electronic watch or clock 30 having a quartz crystal 32. Clock 30 may be used as the load 3 of the embodiments of the invention shown in FIGS. 4–6.

It will be understood that the above description of the present invention is susceptible to various modifications changes and adaptions.

What is claimed is:

1. A direct current stabilization circuit for maintaining the current through a load constant with varations in a D.C. supply voltage source, comprising a first transistor having its emitter-collector electrodes connected in series with said load, said first transistor and said load being coupled across said voltage source, current control means comprising first and second series-connected resistors and a second transistor having base, emitter and collector electrodes, said second transistor having its base electrode connected to the junction of said first and second resistors and its other electrodes coupled to the other ends of said first and second resistors, a third resistor having one end coupled to the other end of said first resistor and the other end thereof to one terminal of said voltage source, and, non-rectifying resistive means coupling the other end of said first resistor to the base electrode of said first transistor, the other end of said second resistor being coupled to the other terminal of said voltage source.

2. A stabilization circuit as defined by claim 1 which further comprises a fourth resistor connected in series with said load.

3. A stabilization circuit as defined by claim 1 wherein the collector and emitter electrodes of said second transistor are coupled to the other ends of said first and second resistors respectively.

4. A stabilization circuit as defined by claim 1 wherein the collector electrode of said second transistor is coupled to the other end of said first resistor by a fourth resistor.

5. A stabilization circuit as defined by claim 4 wherein said fourth resistor has a value such that the ratio of the load current at a given magnitude of said voltage source to the load current when the magnitude of said voltage source is 1 volt is a non-linear function of the magnitude of said source voltage.

6. A stabilization circuit as defined by claim 1 wherein the means coupling the other end of said first resistor to the base electrode of said first transistor includes a fourth resistor.

7. A stabilization circuit as defined by claim 6 wherein the means coupling the other end of said first resistor to the base electrode of said first transistor further includes a fifth resistor.

8. A stabilization circuit as defined by claim 7 which further comprises a sixth resistor coupled between the base electrode of said first transistor and the other terminal of said voltage source.

9. A stabilization circuit as defined by claim 1 wherein the collector and emitter electrodes of said second transistor are coupled to the other ends of said second and first resistors respectively.

10. A stabilization circuit as defined by claim 9 which further comprises a fourth resistor coupling the collector electrode of said second transistor to the other end of said second resistor.

11. A stabilization circuit as defined by claim 10 wherein said first and fourth resistors have values such that the ratio of the load current at a given magnitude of said voltage source to the load current when the magnitude of said voltage source is 1 volt is a non-linear function of the magnitude of said source voltage.

12. A stabilization circuit as defined by claim 10 which further comprises a third transistor having its base and collector electrodes coupled to the collector and emitter electrodes of said second transistor respectively, and its emitter electrode coupled to the other terminal of said voltage source.

13. A stabilization circuit as defined by claim 12 wherein said second and third transistors are complementary.

14. A direct current stabilization circuit as defined by claim 1 wherein said load is a clock having a quartz crystal therein.

* * * * *